US005476220A

United States Patent [19]

Cohoon

[11] Patent Number: 5,476,220

[45] Date of Patent: Dec. 19, 1995

[54] LOCKABLE MAILBOX APPARATUS

[76] Inventor: Michael J. Cohoon, 519 Lisa Ct., El Sobrante, Calif. 94803

[21] Appl. No.: 343,197

[22] Filed: Nov. 22, 1994

[51] Int. Cl.[6] ..... B65D 91/00

[52] U.S. Cl. ..... 232/17; 232/41 D; 70/63

[58] Field of Search ..... 232/41 D, 17; 70/63

[56] References Cited

U.S. PATENT DOCUMENTS

| | | | |
|---|---|---|---|
| 908,770 | 1/1909 | Hartman | 232/41 D |
| 975,455 | 11/1910 | Prevost | 232/41 D |
| 976,261 | 11/1910 | Hodgkinson | 232/41 D |
| 1,046,784 | 12/1912 | Hartman | 232/41 D |
| 1,219,360 | 3/1917 | Storms | 232/41 D |
| 1,448,066 | 3/1923 | Heigh et al. | 232/41 D |
| 1,478,552 | 12/1923 | Chapman | 232/41 D |
| 4,333,603 | 6/1982 | Carlson . | |
| 4,361,271 | 11/1982 | Hester et al. . | |
| 4,382,540 | 5/1983 | Kelly et al. | 232/17 |
| 4,447,005 | 5/1984 | Kelly et al. | 232/41 D |
| 4,565,080 | 1/1986 | Kincaid et al. . | |
| 4,703,635 | 11/1987 | Wyatt . | |
| 4,726,512 | 2/1988 | White . | |
| 5,056,711 | 10/1991 | Bush . | |
| 5,096,115 | 3/1992 | Hassan . | |
| 5,143,284 | 9/1992 | Socarras . | |
| 5,407,126 | 4/1995 | Coultas et al. | 232/17 |

*Primary Examiner*—Michael J. Milano
*Attorney, Agent, or Firm*—Thomas R. Lampe

[57] ABSTRACT

A lockable mailbox apparatus which incorporates a latching mechanism automatically actuated upon opening and subsequent closing of the mailbox closure to positively lock the mailbox closure in closed position relative to the mailbox housing.

8 Claims, 3 Drawing Sheets

LOCKABLE MAILBOX APPARATUS

TECHNICAL FIELD

This invention relates to a mailbox incorporating a lock mechanism for securing the contents of the mailbox against theft. More particularly, the invention allows for ready access to an empty box for servicing by a mail carrier but which will automatically lock in a closed position after the mail delivery person puts the mail in the mailbox.

BACKGROUND ART

Theft from mailboxes is a problem of considerable magnitude. As a consequence, a number of locking devices for mailboxes have been devised. The devices disclosed in the following United States patents are believed to be representative of the current state of the art in this field: U.S. Pat. No. 4,703,635, issued Nov. 3, 1987, U.S. Pat. No. 4,333,603, issued Jun. 8, 1982, U.S. Pat. No. 4,361,271, issued Nov. 30, 1982, U.S. Pat. No. 4,565,080, issued Jan. 21, 1986, U.S. Pat. No. 5,143,284, issued Sep. 1, 1992, U.S. Pat. No. 5,096,115, issued Mar. 17, 1992, U.S. Pat. No. 5,056,711, issued Oct. 15, 1991, and U.S. Pat. No. 4,726,512, issued Feb. 23, 1988.

Prior art arrangements are often characterized by their relative complexity and high cost. Furthermore, many such systems require that the postal carrier take steps over and above the actual delivery of the mail to implement and operate the systems. For example, prior art arrangements can require that the mail delivery person take special actions to lock the mailbox, unlock the mailbox, or both. This results in efficiency and a misuse of the deliverer's time. Cumulatively, this can result in a considerable increase in time and money expended by the postal service when servicing mailboxes.

DISCLOSURE OF INVENTION

The present invention relates to a lockable mailbox apparatus which is relatively simple and inexpensive in construction. A conventional mailbox can be readily converted to adopt the principles of the present invention. Furthermore, such apparatus requires no manipulation by the mail delivery person to utilize the locking system. With the arrangement of the present invention, mere opening of the mailbox closure by the postal delivery person automatically triggers the mechanism required to positively lock the mailbox closure in closed position after the mail has been placed into the interior of the mailbox housing and the closure has been returned to its closed position in the normal course of operation.

The lockable mailbox apparatus of the present invention includes a mailbox housing defining an interior and a front opening communicating with the interior.

A mailbox closure is pivotally attached to the mailbox housing and movable between a closed position wherein the mailbox closure closes the front opening and an open position wherein the mailbox closure does not close the front opening.

Lock means is provided for selectively positively locking the mailbox closure in the closed position. The lock means includes a first latch member attached to and movable with the mailbox closure and a second latch member connected to the mailbox housing and engageable with the first latch member when the mailbox closure is in its closed position.

Biasing means is provided for continuously biasing one of the latch members into latching engagement with the other of the latch members.

Manually operated delatching means moves the biased latch member against the bias of the biasing means to an unlatched position wherein the latch members are unlatched and the mailbox can be opened by manually exerting a pulling force on the mailbox closure.

The apparatus additionally includes retention means for retaining the biased latch member in its unlatched position after the biased latch member is moved to the unlatched position while the mailbox closure is in closed position.

The retention means is responsive to movement of the mailbox closure to the open position from the closed position to allow movement of the biased latch member under the urging of the biasing means from the unlatched position to a position wherein the latch members latchingly engage when the mailbox closure is returned to its closed position.

Other features, advantages, and objects of the present invention will become apparent with reference to the following description and accompanying drawings.

BEST MODE FOR CARRYING OUT THE INVENTION

Figure 1:
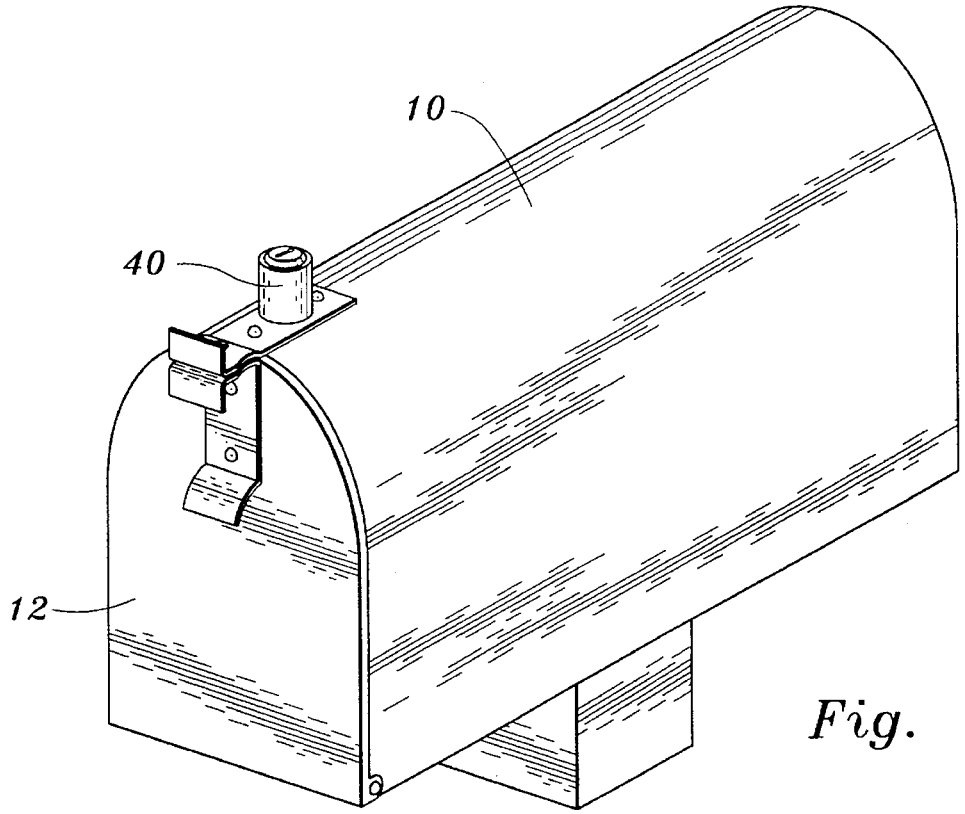
FIG. 1 is a perspective view of apparatus constructed in accordance with the teachings of the present invention.

Referring now to the drawings, a preferred form of lockable mailbox apparatus constructed in accordance with the teachings of the present invention includes a mailbox housing 10 of the so-called rural type. A mailbox closure 12, also of conventional construction, is pivotally attached at the bottom thereof to the housing and is readily manually movable between an open and closed position if not locked in a manner which will be described below.

The apparatus incorporates a lock for locking the closure in closed position. The lock includes a first latch member 14 and a second latch member 16. First latch member 14 is attached to and movable with the mailbox closure 12. Second latch member 16 is connected to the mailbox housing 10 and normally engageable with the first latch member when the mailbox closure is in its closed position. This position is illustrated, for example, in FIG. 2.

Latch member 14 includes a projection 20 having a vertical projection wall 22 and a slanted cam wall 24. Likewise, second latch member 16 includes a projection 28 having a vertical projection wall 30 and a slanted cam wall 32.

In the arrangement illustrated, projection 28 is bifurcated to define a notch 34 (FIG. 7) for receiving a portion of the first latch member 14 when the latch members are latched together. This arrangement allows the mechanism to occupy a smaller space within the interior of the mailbox housing than might otherwise be the case.

Figure 2:
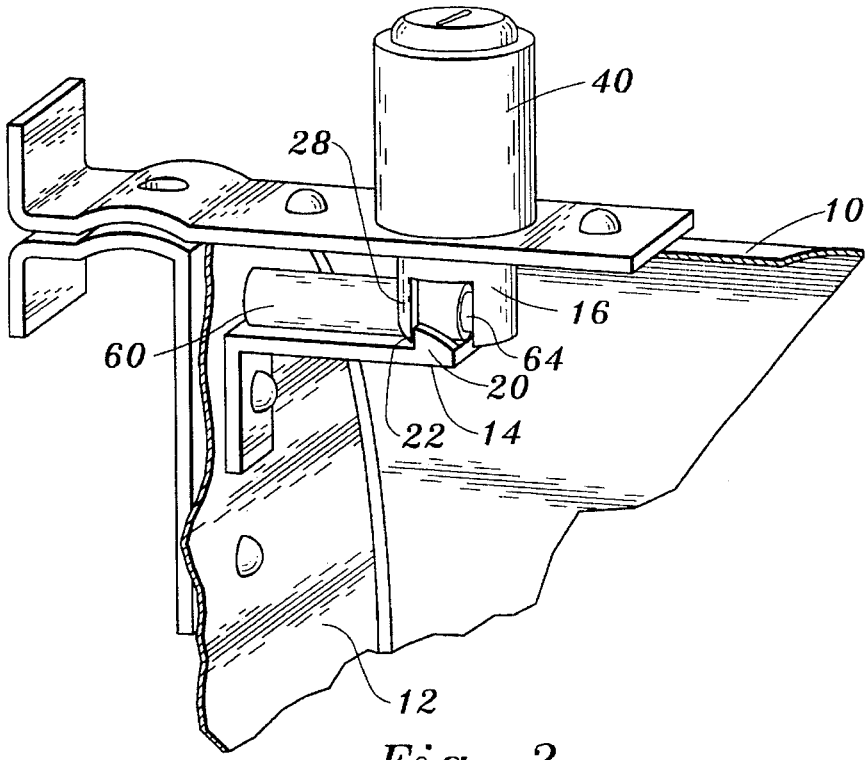
FIG. 2 is an enlarged, sectional view of a portion of the mailbox housing and mailbox closure and the relative positions assumed by related structure including the lock means when the mailbox closure is locked in closed position.

FIG. 2 shows the latch members in latched condition with the closure in its closed position. It will be seen that the vertical projection walls of the latch members 14, 16 are in engagement, thus locking the closure 12 in closed position. Although only one projection 20 is shown on first latch member 14, it is understood that a projection of like construction may be deployed so that the projections of the latch members engage at two locations, i.e. on both sides of the notch 34.

Second latch member 16 is continuously urged in a downward direction by a coil compression spring 36 disposed thereabove and bearing against the second latch member 16. This may perhaps best be seen with reference to FIGS. 6 and 8 wherein the coil compression spring 36 bears downwardly against a circular upper surface 38 of the second latch member.

The second latch member and coil compression spring are located within a cylindrical member 40 which is secured to the top of the mailbox housing and projects upwardly therefrom. Also disposed within member 40 is a key-operated rotatable cylinder 42 having a key hole or slot 44 at the upper end thereof.

The outer cylindrical surface of rotatable cylinder 42 has a cam 46 affixed thereto which has two opposed ramps or cam surfaces 48 which curve upwardly, and are disposed on opposite sides of the rotatable cylinder.

Figure 7:
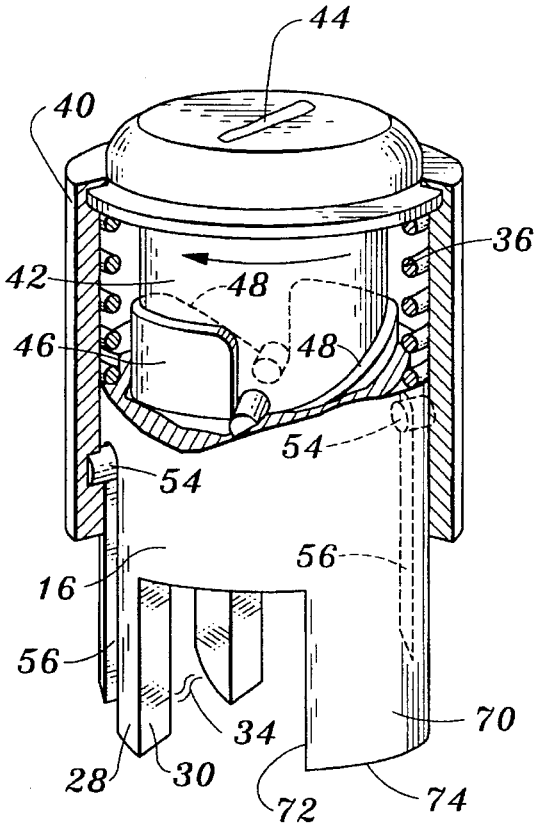
FIG. 7 is an enlarged, perspective view in partial cross-section illustrating details of a biased latch member employed in the apparatus and related structure with the biased latch member in a lowered position.
Figure 8:
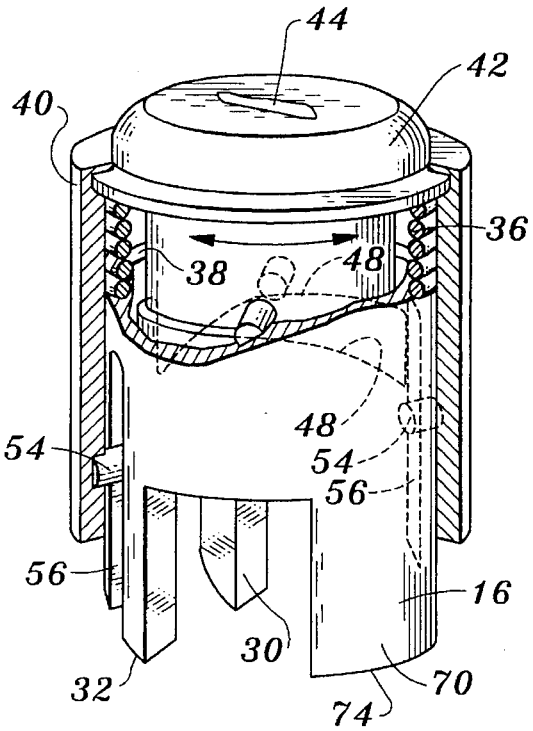
FIG. 8 is a view similar to FIG. 7 but showing the biased latch member raised.

Bosses 50 are affixed to and project inwardly from latch member 16 on opposed sides thereof. The bosses are positioned on cam 46. Thus, rotation of rotatable cylinder 42 by a key 52 (FIGS. 3 and 4) will draw second latch member 16 upwardly against the urging of spring 36, the bosses moving upwardly on ramps 48. FIGS. 7 and 8, respectively, show the second latch member 16 in lowered and raised positions. Pins 54 are affixed to cylindrical member 40, project inwardly therefrom, and are disposed in slots 56 formed in second latch member 16. The second latch member 16 can slide up and down relative to pins 54 but cannot rotate.

First latch member 14 includes a cylindrically shaped element 60 having a coil compression spring 62 disposed therein. A plunger 64 is slidably mounted in cylindrically-shaped element 60 and the coil compression spring 62 continually urges the plunger 64 to its outermost position shown, for example, in FIGS. 4 and 5. The plunger 64 has an enlarged head 66 within element 60 engaging with an inwardly turned lip at the open end of the cylindrically-shaped element to prevent the plunger from completely leaving element 60.

Figure 3:
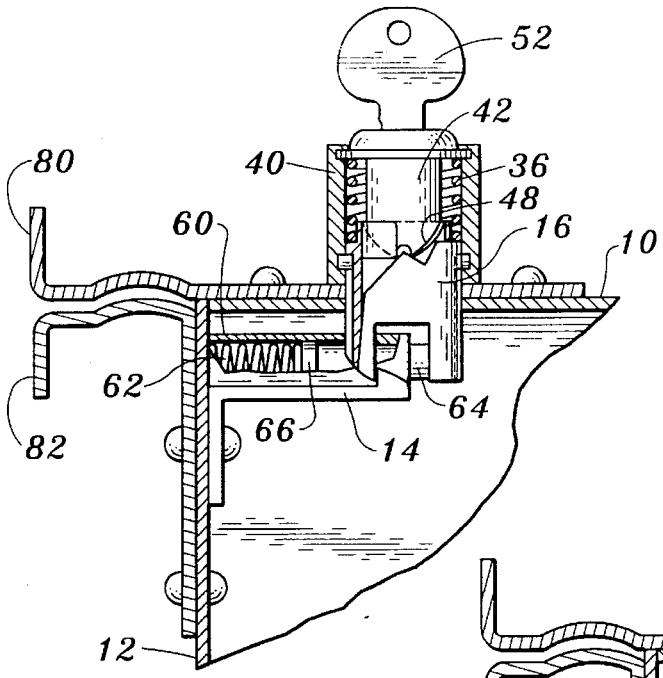
FIGS. 3, 4, 5, and 6 are diagrammatic, cross-sectional views illustrating relative positions assumed by selected components of the apparatus at different stages of operation of the apparatus.

In FIGS. 2 and 3, the second latch member 16 is disposed in its normal position, that is, the position assumed thereby when a key has not been utilized to draw the second latch member upwardly against the urging of spring 36. This condition is also illustrated in FIG. 7.

Second latch member 16 has an abutment member 70 projecting downwardly therefrom. Abutment member 70 has a first abutment surface 72 which is vertically oriented and a second abutment surface 74 at the bottom of the abutment member.

Figure 6:
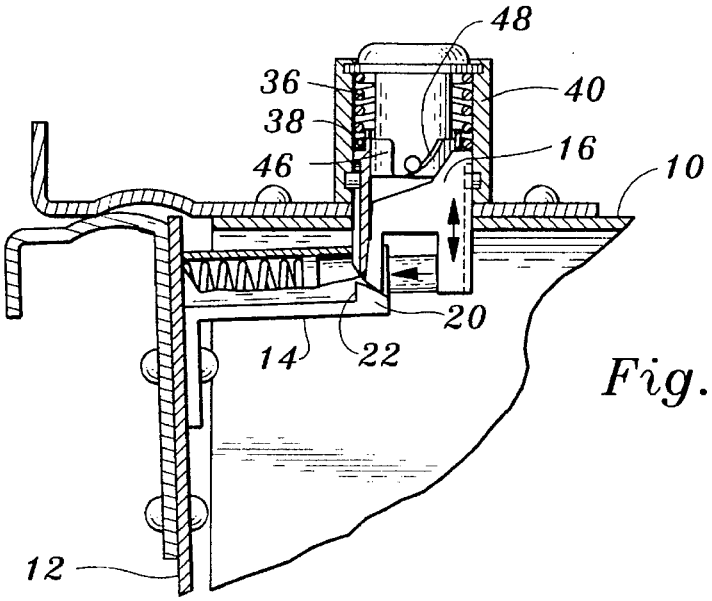

When the mailbox closure 12 is closed and the second latch member 16 is in its normal lowered condition, the outer distal end of the plunger 64 will engage first abutment surface 72 of the abutment member, telescoping the plunger 64 into cylindrically-shaped element 60 against the urging of coil compression spring 62. It will be noted that in the process of closing mail box closure 12, the slanted cam walls 24, 32 of projections 20, 28 will engage to push second latch member 16 upwardly. The plunger 64 engages first abutment surface 72 of abutment member 70 and is pushed into cylindrically-shaped element 60. This is shown in FIG. 6, with arrows designating the respective movements of the second latch member and the plunger.

FIGS. 2 and 3 show the condition of the structural elements after the projections have cleared and spring 36 has moved second latch member 16 downwardly into latching engagement with the first latch member. In such condition, the structural components of the apparatus positively prevent opening of the closure.

Figure 4:
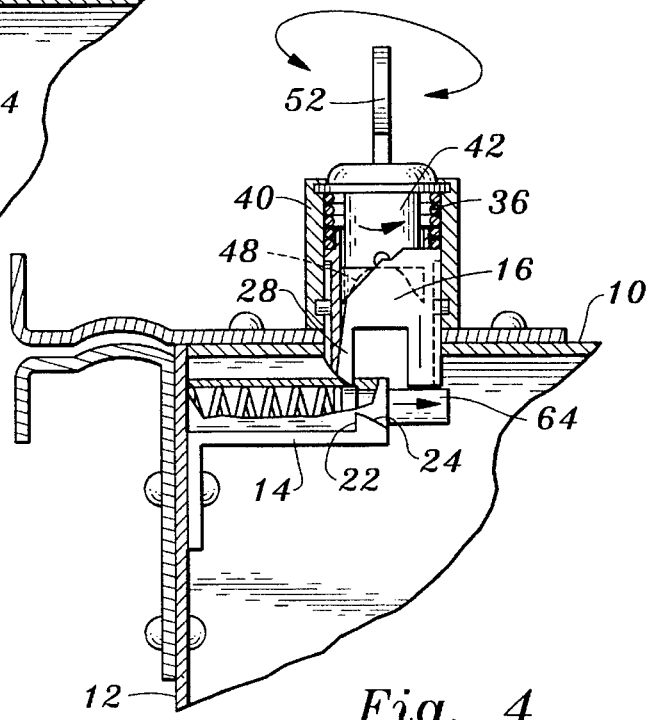
Figure 5:
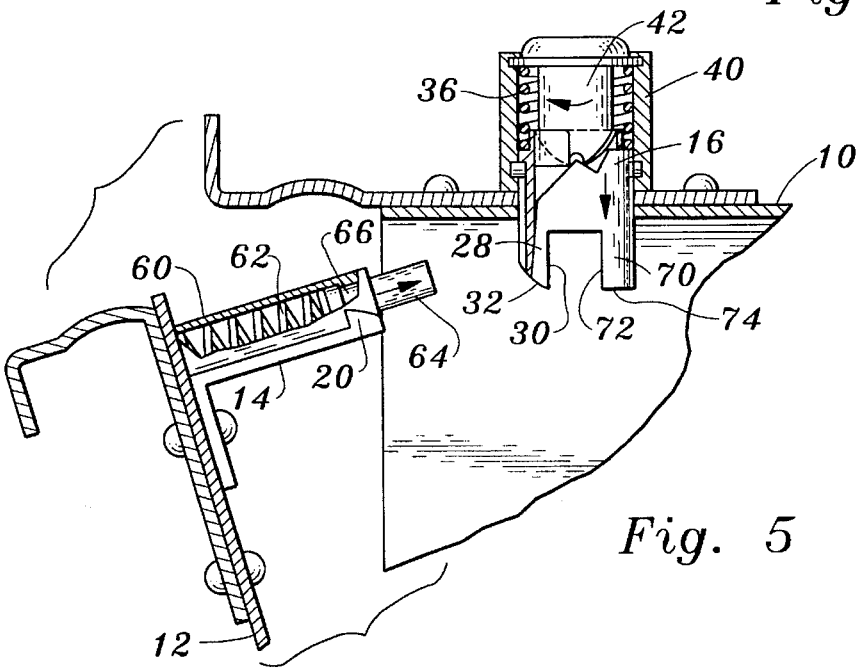

In order to open the mailbox, the recipient of the mail must insert key 52 into the key slot of rotatable cylinder 42 and rotate the key to pull the second latch member upwardly as shown in FIG. 4. Once abutment member 70 clears the end of plunger 64, spring 62 will move the plunger to the right as viewed in FIG. 4 and place it under second abutment surface 74 of the abutment member. Also, of course, the projection 28 will be pulled away from projection 20. This will enable the person receiving the mail to readily open the mailbox closure 12 and retrieve the contents of the mailbox.

The user then closes the mailbox with the second latch member 16 remaining in its uppermost or retracted position. In the arrangement illustrated, this can be assured by manually manipulating the mechanism with the key to retain the second latch member up until the closure is closed. Alternatively, a more complicated, albeit conventional, lock mechanism may be employed to provide for this automatically.

In any event, the fact that the second latch member 16 is in the raised position as illustrated in FIG. 4, allows the plunger 64 to move under the abutment. The second abutment surface rests upon the plunger and the plunger will serve to maintain the second latch member in elevated condition. This enables the mail deliverer to readily open the mailbox closure 12 by exerting a pulling force thereon since the latch members are not in latching engagement. However, once the mail deliverer opens the door the second latch member will move downwardly under the urging of the coil compression spring 36, again providing for automatic latching of the mechanism when the mail has been inserted in the mail box interior and the closure closed.

In the arrangement illustrated, the mailbox includes a supplemental lock including a first supplemental lock member 80 and a second supplemental lock member 82, the latter acting as a handle which may be used to open up the mailbox closure. The supplemental lock members are of somewhat resilient sheet metal construction and may typically be the standard types of frictional locks or retainers commonly utilized in rural mailbox installations. Usually such members comprise the sole means for maintaining a mailbox closure in closed position simply through frictional engagement. Members 80, 82 operate in the same manner and perform the same function in the present instance when the second latch member 16 is in its raised position.

I claim:

1. Lockable mailbox apparatus comprising, in combination:

a mailbox housing defining an interior and a front opening communicating with said interior;

a mailbox closure pivotally attached to said mailbox housing and movable between a closed position wherein said mailbox closure closes said front opening and an open position wherein said mailbox closure does not close said front opening;

lock means for selectively positively locking said mailbox closure in said closed position, said lock means including a first latch member attached to and movable with said mailbox closure and a second latch member connected to said mailbox housing and engageable with said first latch member when said mailbox closure is in said closed position;

biasing means for continuously biasing one of said latch members into latching engagement with the other of said latch members;

manually operated delatching means for moving the biased latch member against the bias of said biasing means to an unlatched position wherein said latch members are unlatched and said mailbox can be opened by manually exerting a pulling force on said mailbox closure; and retention means for retaining said biased latch member in said unlatched position after said biased latch member is moved to the unlatched position while the mailbox closure is in closed position, said retention means being responsive to movement of said mailbox closure to said open position from said closed position to allow movement of said biased latch member under the urging of said biasing means from the unlatched position to a position wherein said latch members latchingly engage when said mailbox closure is returned to said closed position, said second latch member comprising said biased latch member and projecting downwardly into the interior of said mailbox housing closely adjacent to said front opening, said first latch member projecting through said front opening into the interior of said mailbox housing when the mailbox closure is in said closed position and removed from said front opening and the interior of said mailbox housing when said mailbox closure is in said open position, said retention means comprising a spring biased plunger on said first latch member and movable relative to said first latch member, and said lockable mailbox apparatus including an abutment member having a first abutment surface and projecting downwardly from said second latch member, said spring biased plunger engaging the first abutment surface of said abutment member to telescope the spring biased plunger relative to said first latch member when said second latch member has been moved downwardly under the urging of said biasing means to the position wherein said latch members latchingly engage and said mail box closure is in said closed position.

2. The lockable mailbox apparatus according to claim 1 wherein said first latch member includes a first projection and wherein said second latch member includes a second projection, said projections engageable during movement of said mailbox closure from said open position to said closed position to cam the biased latch member and move the biased latch member against the bias of said biasing means prior to latching of said latch members.

3. The lockable mailbox apparatus according to claim 1 additionally comprising a supplemental lock including a first supplemental lock member affixed to said mailbox closure and a second supplemental lock member affixed to said mailbox housing, said first and second supplemental lock members being in frictional locking engagement when said mailbox closure is in said closed position and said latch members are in latching engagement.

4. The lockable mailbox according to claim 1 wherein said abutment member includes a second abutment surface, said spring biased plunger responsive to upward movement of said second latch member to disengage from the first abutment surface of said abutment member and extend under the second abutment surface of said abutment member for engagement by the second abutment surface to positively prevent downward movement of said second latch member.

5. The apparatus according to claim 1 wherein said second latch member defines a notch for receiving said first latch member.

6. Lockable mailbox apparatus comprising, in combination:

a mailbox housing defining an interior and a front opening communicating with said interior;

a mailbox closure pivotally attached to said mailbox housing and movable between a closed position wherein said mailbox closure closes said front opening and an open position wherein said mailbox closure does not close said front opening;

lock means for selectively positively locking said mailbox closure in said closed position, said lock means including a first latch member attached to and movable with said mailbox closure and a second latch member connected to said mailbox housing and engageable with said first latch member when said mailbox closure is in said closed position;

biasing means for continuously biasing one of said latch members into latching engagement with the other of said latch members;

manually operated delatching means for moving the biased latch member against the bias of said biasing means to an unlatched position wherein said latch members are unlatched and said mailbox can be opened by manually exerting a pulling force on said mailbox closure; and retention means for retaining said biased latch member in said unlatched position after said biased latch member is moved to the unlatched position while the mailbox closure is in closed position, said retention means being responsive to movement of said mailbox closure to said open position from said closed position to allow movement of said biased latch member under the urging of said biasing means from the unlatched position to a position wherein said latch members latchingly engage when said mailbox closure is returned to said closed position, said manually operated delatching means including a key-operated rotatable cylinder having a cylindrical surface and defining a cam surface curving upwardly about at least a portion of said cylindrical surface, said apparatus additionally comprising a boss projecting from said biased latch member and positioned on said cam surface, rotation of said key-operated rotatable cylinder moving said boss upwardly on said cam surface to move said biased latch member to said unlatched position.

7. The apparatus according to claim 6 wherein a plurality of bosses project from said biased latch member and are positioned on said cam surface.

8. The apparatus according to claim 6 additionally comprising means for preventing rotation of said biased latch member when said key-operated rotatable cylinder is rotated.

* * * * *